United States Patent [19]

Charpentier et al.

[11] 4,092,179

[45] May 30, 1978

[54] METHOD OF PRODUCING HIGH STRENGTH COLD ROLLED STEEL SHEET

[75] Inventors: Philippe L. Charpentier, Pittsburgh; Robert H. Goodenow, Bethel Park; William E. Dennis, Pittsburgh, all of Pa.

[73] Assignee: Jones & Laughlin Steel Corporation, Pittsburgh, Pa.

[21] Appl. No.: 755,364

[22] Filed: Dec. 27, 1976

[51] Int. Cl.[2] ..... C21D 7/10; C21D 7/14; C21D 9/46

[52] U.S. Cl. ..... 148/2; 148/12 F; 148/36

[58] Field of Search ..... 148/2, 3, 12 R, 12 F, 148/36, 39; 164/56, 57

[56] References Cited

U.S. PATENT DOCUMENTS

| | | | |
|---|---|---|---|
| 2,387,919 | 10/1945 | Lose | 148/36 |
| 3,556,866 | 1/1971 | Gibbs et al. | 148/2 |
| 3,615,278 | 10/1971 | Yamamoto et al. | 148/39 X |
| 3,666,570 | 5/1972 | Korchynsky et al. | 148/12 F |
| 3,668,016 | 6/1972 | Shimizu et al. | 148/2 |
| 3,754,591 | 8/1973 | Bales et al. | 75/124 |
| 3,926,686 | 12/1975 | Creswick et al. | 148/12 F |
| 3,928,083 | 12/1975 | Gondo et al. | 148/2 |
| 3,947,293 | 3/1976 | Takechi et al. | 148/12 F |
| 3,976,514 | 8/1976 | Matsukura et al. | 148/12 F |

FOREIGN PATENT DOCUMENTS

| | | | |
|---|---|---|---|
| 45-37,438 | 11/1970 | Japan | 164/56 |

*Primary Examiner*—W. Stallard

*Attorney, Agent, or Firm*—G. K. White; T. A. Zalenski

[57] ABSTRACT

A high-strength, cold rolled steel sheet product characterized by a rimmed surface and an aluminum killed, columbium-containing core is produced by hot rolling at a finishing temperature above its $Ar_3$ temperature and coiling at a temperature between 1000° F. and 1200° F., cold rolling between 50% and 90% reduction, batch annealing to recrystallize the coil, and temper rolling between 0.75% and 2.0% temper elongation. The product is non-aging, has a 50,000 p.s.i. minimum yield strength in the temper rolled condition, good formability, and a surface quality equivalent to that of Drawing Quality Rimmed Steel.

8 Claims, No Drawings

METHOD OF PRODUCING HIGH STRENGTH COLD ROLLED STEEL SHEET

The invention involves the production of non-aging, high-strength, cold rolled steel sheet coils in the annealed and temper rolled condition and having a minimum yield strength of 50,000 p.s.i., good formability, and a surface quality equivalent to that of Drawing Quality Rimmed Steel. Products having the above properties may be produced by subjecting a steel casting having a rimmed surface zone and an aluminum killed core containing columbium to thermo-mechanical processing which includes hot rolling at a finishing temperature in excess of the $Ar_3$ temperature of the steel and coiling at a temperature between 1000° F. and 1200° F., pickling, cold rolling, batch recrystallization annealing, and temper rolling to between 0.75% and 2.0% temper elongation.

The production of so-called "core killed " ingots is known in the art. Typical techniques include those disclosed by U.S. Pat. Nos. 2,387,919; 3,593,774; 3,414,042; 3,754,591; 2,108,254; 2,236,504; 2,819,503; 3,414,041; 1,073,735; and 3,865,643. Of these patents, Patent Numbers 3,865,643, and 3,754,591 also provide for columbium core additions. Moreover, the art has previously processed core killed ingots into flat rolled products as illustrated by U.S. Pat. Nos. 3,615,278; 2,389,516; 3,556,866; and 3,668,016. None of these patents specifically pertain to aluminum core killed products having columbium added to the core nor do they relate to the process of the invention.

It is an object of the invention to produce a flat rolled product having a combination of properties that includes the good formability of an aluminum killed steel, the good surface quality of a rimmed steel, a high yield strength, and non-aging behavior. Specifically, it is an object to produce a flat rolled steel product having a minimum yield strength of 50,000 p.s.i. in the temper rolled condition and a surface quality equivalent to that of Drawing Quality Rimmed Steel. Further objectives of the invention include producing a product having good formability and being non-aging. A yet further objective is to provide a process capable of routinely producing the above stated property objectives.

These and other objectives and advantages will be apparent to those skilled in the art from the following description of the invention.

Steels suitable for use in the invention may be manufactured conventionally by processes such as the open hearth, basic oxygen or electric furnace. Following steelmaking, molten steel containing from about 0.07% to 0.11% carbon and 0.6% maximum manganese may be teemed into an ingot mold and permitted to rim in the mold for sufficient time to form a solid zone or shell along the mold surfaces. Typically rimming times on the order of two to eight minutes are involved. The carbon content of the steel should be from 0.07% to 0.11% and the manganese content restricted to 0.6% maximum to permit good rimming action. Rimming will typically cause a carbon content loss of about 0.01% to 0.02% minimum in the rimmed zone. At this point in the process the steel should not contain elements that would tie up oxygen to an extent inconsistent with obtaining good rimming action in the mold. Thus significant quantity of elements having a high affinity for oxygen such as columbium, zirconium, vanadium, rare earth elements, silicon and aluminum should not be initially present in the molten steel.

Following formation of the rimmed zone the remaining molten steel in the core of the mold is killed through the addition of sufficient amounts of a deoxidizing agent such as aluminum or the like. Typically from 0.04% to 0.06% Al is added at this stage for the dual purpose of producing a killed core and to ensure substantial freedom from aging due to free nitrogen in solid solution. Ferro-columbium in an amount sufficient to result in about a 0.08% to 0.12% columbium content in the core is also added at this point. The lower limit is selected for the purpose of ultimately attaining a minimum yield strength of 50,000 p.s.i. in the annealed and temper rolled condition. Amounts in excess of about 0.12% lead to strength levels that are too high for good formability and also may impair the uniformity of mechanical properties in batch annealed products. Other alloy additions such as vanadium and molybdenum may be added to the core if desired. Sulfide shape control agents such as Zr, rare earths, or mixtures thereof may also be added to the core in amounts effective to form globular sulfides. Such amounts are typically 0.05% to 0.12% Zr and 0.01% to 0.10% rare earths, depending upon the sulphur content of the steel.

A typical ingot-making procedure involves preparing a plain low carbon steel within the chemical composition limits described above and teeming the steel into a big end down ingot mold with sideboard hot-top. The mold is filled to about the bottom of the hot top and permitted to rim for, on the order of, six minutes, to produce a solid zone or shell. Rimming action is then stopped by adding aluminum to the remaining molten steel core concurrent with a molten metal back pouring operation to fill the mold. Such aluminum addition procedure results in the formation of small sized deoxidation products which do not later impair cold formability of the ultimate product. A ferro columbium addition is also made with the aluminum addition to provide the requisite amount of strength.

Following completion of solidification, the cast product is subjected to blooming and then hot rolling. Finish rolling should be conducted above the $Ar_3$ temperature to promote grain size uniformity. A temperature of 1500° F. or higher has been found to be convenient for the steels of the invention. Coiling should be conducted at a temperature from about 1000° F. to 1200° F. The lower limit represents a practical limitation due to cooling capabilities of most hot strip mill facilities while coiling temperatures in excess of about 1200° F. could result in excessive grain growth and yield strengths less than 50,000 p.s.i. in the final product. It is preferred to coil the hot rolled steel at a temperature between 1050° F. and 1150° F. to further ensure that a fine grained product and minimum yield strength objectives are obtained.

Following pickling, the hot rolled strip is cold rolled in a conventional manner using a reduction in thickness of about 50% to 90%.

The cold rolled coil is then batch annealed to effect full recrystallization of its wrought microstructure. To achieve the combination of a 50,000 p.s.i. minimum yield strength after temper rolling and good formability, the annealing is conducted within a restricted temperature range for a specific time period. A maximum temperature of on the order of 1275° F. is utilized for any portion of the coil because higher temperatures lead to yield strength levels below 50,000 p.s.i. following annealing and temper rolling due to excessive grain growth. On the other hand, the steel coil should be subjected to a minimum temperature on the order of 1175° F. for a minimum time period on the order of five hours to obtain full recrystallization and consequent uniformity of mechanical properties throughout the entire coil. As these limits necessarily involve the minimization of temperature gradients within the coil during annealing, the use of a heat shield such as disclosed in U.S. Pat. No. 3,879,167 together with top temperature control and a low furnace temperature are preferred.

The above discussed maximum and minimum annealing temperatures are related to the columbium content as it is preferred to use generally higher annealing temperatures with higher columbium contents because columbium functions to retard recrystallization and grain growth. Accordingly, minimum and maximum temperatures of 1225° F. and 1275° F., respectively are preferred for steels having about 0.12% Cb. On the other hand, minimum and maximum annealing temperatures of 1175° F. and 1225° F. respectively are preferred for steels having about 0.08% Cb. For columbium contents between 0.08% and 0.12%, the minimum and maximum annealing temperatures both depend linearly upon the columbium content.

The recrystallized coil is then temper rolled to effect from about 0.75% to 2.0% temper elongation. Such amounts of temper elongation are greater than those normally employed for low carbon steels. This is because the fine grained micro-structure of the high strength steel results in a large yield point elongation which in turn requires a large amount of temper elongation for its elimination. For this reason, a temper elongation from about 1.5% to 2.0% is preferred.

The product produced by the process of the invention possesses an outstanding combination of four properties. It has high strength, good surface quality, good formability, and is non-aging. Minimum strength levels of 65,000 p.s.i. ultimate tensile strength and 50,000 p.s.i. yield strength are obtained in the annealed and temper rolled condition. This high strength steel product is also readily formable. Its formability, as measured by total tensile elongation, is superior to that of plain carbon steels of the same strength level, as represented by ASTM standard A 611-72. A total elongation in 2 inches of 20% is typically obtained for a thickness of 0.030 inch for products of the invention. The product also is characterized by a good surface finish which is equivalent to that of Drawing Quality Rimmed Steel as defined in "Steel Products Manual" on "Carbon Sheet Steel" published by The American Iron and Steel Institute (April 1974). A surface quality of this nature enables the product to be used for critical, exposed applications which require in addition both high strength and good formability. Finally, the aging response of the steel is equivalent to that of a Drawing Quality Special Killed cold rolled steel, also defined in the above mentioned American Iron and Steel Institute publication. As a result of this essentially non-aging characteristic, the product of the invention may be used for applications involving exposed locations where surface appearance is critical. In particular, the product is essentially immune to stretcher strains for extended periods following temper rolling.

To demonstrate the feasibility of the process, three coils were produced from three ingots teemed in accordance with the practice described previously. The plain carbon steel initially teemed into the ingot mold had a composition of 0.08%C, 0.33%Mn, 0.007%P, and 0.031%S. The average columbium and aluminum contents in the final product (core plus rim zone) were 0.084% and 0.48%, respectively.

The three ingots were hot rolled to a thickness of 0.076 inch using a finishing temperature of between 1560° F. and 1620° F. and a coiling temperature ranging between 1000° F. and /1150° F. Following pickling, the coils were cold rolled to a nominal thickness of 0.030 inch. Batch annealing was conducted in a single stack furnace with use of a top heat shield, top temperature control, and a low furnace temperature of 1400° F. The hottest portion of each coil was not permitted to exceed 1235° F. and was at such temperature for 11 hours while the coldest portion of the coil was maintained above 1175° F. for 7 hours (maximum cold spot temperature reached 1210° F.). The coils were then temper rolled between 1.0% and 1.25% elongation and sheared into sheets from which samples were taken for evaluation

TABLE I

| | | TENSILE PROPERTIES | | | | |
|---|---|---|---|---|---|---|
| Specimen Location | Specimen Orientation | Yield Strength* (ksi) | Ultimate Tensile Strength (ksi) | Yield Point Elongation (%) | Uniform Elongation (%) | Total Elongation in 2" (%) |
| Strip | Longitudinal | 52/57 | 69/72.5 | 0/1.3 | 14/17.2 | 18/22.2 |
| Center | Transverse | 55.5/60.5 | 70.5/74.4 | 0/1.25 | 13/15.7 | 17/5/22.7 |
| Strip | Longitudinal | 51.5/55.5 | 67/71 | 0/1.0 | 13.7/17.5 | 18.2/23.5 |
| Edge | Transverse | 55/59 | 69/73 | 0/1.1 | 13.2/17.7 | 18/21.7 |

*Yield Point or 0.2% offset depending on the yielding behavior of the particular specimen. No upper yield point was present in this material.

Tensile properties are summarized in Table I. As evident from the data, all yield strength values were greater than 50,000 p.s.i. and all ultimate tensile strength values were in excess of 65,000 p.s.i. Total elongation in 2 inches ranged from 17.5% to 23.5%.

The strain aging behavior of the steel was evaluated through use of tests involving 5% and 10% tensile prestrain followed by an aging treatment of one hour at 212° F. The results, along with values typical for a low carbon rimmed steel are listed in Table II. The results demonstrate that, in comprarison with a rimmed steel, the product of the invention exhibits minimal amounts of aging. The aging index of the inventive product closely resembles that of aluminum killed low carbon sheet steel.

TABLE II

STRAIN-AGING INDEX OF RIMMED STEEL AND STEEL OF INVENTION

| Steel | % Tensile Prestrain | Aging Index (p.s.i.) |
|---|---|---|
| Rimmed | 5 | 6219 |
| | 10 | 5940 |
| Invention | 5 | 560 |
| | 10 | 210 |

The steel of the invention was also contrasted with a low carbon rimmed steel with regard to fluting tendency. Comparative samples were deformed in an Olsen type stretch test (3.75 inches hemispherical punch) following aging for ½ hour at 350° F. The rimmed steel exhibit extensive stretcher strains while the inventive product did not exhibit such markings.

We claim:

1. A method for producing a high strength, cold rolled sheet steel product having a surface quality equivalent to that of Drawing Quality Rimmed Steel, comprising:

a. teeming molten steel having a carbon content of about 0.07% to 0.11% and a manganese content of 0.6% manganese maximum into a mold and permitting said molten steel to rim in said mold for a sufficient time to cause said molten steel to solidify as a solid zone on the mold surfaces;

b. adding a sufficient amount of aluminum to molten steel contained in the core of said mold to kill the molten steel core and to ensure substantial freedom from nitrogen aging and adding sufficient columbium to said core to result in a columbium content of about 0.08% to 0.12% in the core;

c. permitting said molten steel core to solidify and form an ingot;

d. hot rolling said ingot into a flat product at a finishing temperature above its $Ar_3$ temperature and coiling said product at a temperature of from about 1000° F. to 1200° F.;

e. cold rolling the coiled product in an amount of from about 50% to 90% reduction in thickness;

f. batch annealing the coiled product to obtain full recrystallization by maintaining said coil at a minimum temperature of about 1175° F. for a minimum of about 5 hours and not permitting any portion of the coil to exceed a maximum temperature of 1275° F.; and g. temper rolling said coil from about 0.75% to 2.0% temper elongation thereby obtaining a yeild strength of 50,000 p.s.i. minimum.

2. The method of claim 1, wherein:

said hot roll finishing temperature is no lower than about 1500° F.

3. The method of claim 1, wherein:

said coiling temperature is from about 1050° F. to 1150° F.

4. The method of claim 1, wherein:

an effective amount of a member selected from the group consisting of rare earths, zirconium, and admixtures thereof to form globular sulfides is added to said molten metal core.

5. The method of claim 1, wherein:

said temper rolling of the coil is from about 1.5% to 2.0% elongation.

6. The method of claim 1, wherein:

said columbium content is about 0.08% and said maximum batch annealing temperature is about 1225° F.

7. The method of claim 1, wherein:

said columbium content is about 0.12% and said minimum batch annealing temperature is about 1225° F.

8. A high strength low carbon cold rolled steel coil in the annealed and temper rolled condition having a surface zone comprising a rimmed steel consisting essentially of about 0.05% to 0.10% carbon, 0.6% manganese maximum, balance essentially iron and a core comprising an aluminum killed steel consisting essentially of about 0.07% to 0.11% carbon, 0.6% manganese maximum, and 0.08% to 0.12% columbium, balance essentially iron; said coil having a yield strength of 50,000 p.s.i. minimum, a surface quality equivalent to that of Drawing Quality Rimmed Steel; formability superior to that of plain carbon steels of the same strength level and thickness, and an aging response equivalent to that of Drawing Quality Special Killed steel.

* * * * *

UNITED STATES PATENT OFFICE

CERTIFICATE OF CORRECTION

Patent No. 4,092,179 Dated May 30, 1978

Inventor(s) Philippe L. Charpentier, Robert H. Goodenow and William E. Dennis

It is certified that error appears in the above-identified patent and that said Letters Patent are hereby corrected as shown below:

Column 4, line 12: "0.48%" should be --0.048%--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*